US009612092B2

(12) United States Patent
Chester

(10) Patent No.: US 9,612,092 B2
(45) Date of Patent: Apr. 4, 2017

(54) PORTABLE TARGET SHOOTING SYSTEM WITH SENSORS AND REMOTE CONTROL

(71) Applicant: Apex Target Systems LLC, Tiffin, OH (US)

(72) Inventor: Jamie L. Chester, Tiffin, OH (US)

(73) Assignee: Apex Target Systems LLC, Tiffin, OH (US)

( * ) Notice: Subject to any disclaimer, the term of this patent is extended or adjusted under 35 U.S.C. 154(b) by 0 days.

(21) Appl. No.: 14/852,725

(22) Filed: Sep. 14, 2015

(65) Prior Publication Data

US 2016/0076859 A1 Mar. 17, 2016

Related U.S. Application Data

(60) Provisional application No. 62/050,255, filed on Sep. 15, 2014.

(51) Int. Cl.

| | |
|---|---|
| ***F41J 5/056*** | (2006.01) |
| ***F41J 7/04*** | (2006.01) |
| ***F41J 5/14*** | (2006.01) |
| *F41J 1/10* | (2006.01) |
| *F41J 5/06* | (2006.01) |

(52) U.S. Cl.

CPC ..... *F41J 7/04* (2013.01); *F41J 5/056* (2013.01); *F41J 5/14* (2013.01); *F41J 1/10* (2013.01); *F41J 5/06* (2013.01)

(58) Field of Classification Search

CPC ..... F41J 5/056; F41J 5/06; F41J 7/04; F41J 5/14

USPC ..... 273/390–392, 406, 371, 372

See application file for complete search history.

(56) References Cited

U.S. PATENT DOCUMENTS

| | | | | | |
|---|---|---|---|---|---|
| 3,194,066 | A | * | 7/1965 | Schwab | F41J 1/10 273/392 |
| 4,119,317 | A | * | 10/1978 | Ohlund | F41J 7/06 273/406 |
| 4,222,564 | A | * | 9/1980 | Allen | F41J 5/00 273/369 |
| 4,239,234 | A | * | 12/1980 | Ward | F41J 7/04 273/391 |
| 4,261,579 | A | * | 4/1981 | Bowyer | B29C 70/70 235/400 |
| 4,540,182 | A | * | 9/1985 | Clement | F41J 7/04 273/391 |

(Continued)

*Primary Examiner* — Mark Graham

(74) *Attorney, Agent, or Firm* — Ward Law Office LLC; Jacob M. Ward

(57) ABSTRACT

A target shooting system includes an actuator, one or more impact sensors, a controller, and can include a remote device. The actuator couples a target member to a base member and is configured to move the target member relative to the base member. The one or more impact sensors are coupled to the target member, where multiple impact sensors can be configured to identify a location of an impact on the target member and to provide a signal including the location when the target member receives the impact. The controller is communication with the actuator and the one or more impact sensors and is configured to cause the actuator to move the target member relative to the base member and to receive the signal from the impact sensor. The remote device can communicate with the controller and can receive the signal and the impact location from the controller.

11 Claims, 5 Drawing Sheets

(56) References Cited

U.S. PATENT DOCUMENTS

| | | | | | |
|---|---|---|---|---|---|
| 5,095,433 | A * | 3/1992 | Botarelli | F41J 5/056 | 235/400 |
| 5,403,017 | A * | 4/1995 | Doss, III | F41J 7/04 | 273/372 |
| 5,695,196 | A * | 12/1997 | Yanosky | F41J 7/04 | 273/392 |
| 5,934,678 | A * | 8/1999 | Theissen | F41J 7/06 | 273/386 |
| 7,694,973 | B1 * | 4/2010 | Hofmeister | F41J 7/06 | 273/391 |
| 7,900,927 | B1 * | 3/2011 | Bliehall | F41J 9/02 | 273/359 |
| 8,047,546 | B1 * | 11/2011 | Klein | F41J 7/06 | 273/392 |
| 8,608,169 | B2 * | 12/2013 | Saunders | F41J 7/04 | 273/392 |
| 2010/0038854 | A1 * | 2/2010 | Mraz | F41J 5/056 | 273/371 |
| 2010/0225062 | A1 * | 9/2010 | Shum | F41J 7/06 | 273/359 |
| 2012/0043722 | A1 * | 2/2012 | Mironichev | F41J 7/04 | 273/406 |
| 2014/0367918 | A1 * | 12/2014 | Mason | F41J 5/04 | 273/371 |
| 2015/0102563 | A1 * | 4/2015 | Gwash | F41J 7/06 | 273/390 |

* cited by examiner

PORTABLE TARGET SHOOTING SYSTEM WITH SENSORS AND REMOTE CONTROL

CROSS-REFERENCE TO RELATED APPLICATIONS

This application claims the benefit of U.S. Provisional Application No. 62/050,255, filed on Sep. 15, 2014. The entire disclosure of the above application is hereby incorporated herein by reference.

FIELD

The present disclosure relates to target shooting systems, including portable target shooting systems with remote control and impact reporting for one or more targets.

BACKGROUND

This section provides background information related to the present disclosure which is not necessarily prior art.

Various firearm users, whether they are law enforcement officers, military personnel, Olympic shooters, sportswomen and sportsmen, hunters, professional competitors, or weekend enthusiasts, all share one common goal, namely: hitting a target accurately and consistently. Accuracy and consistency in shooting often depends largely on the skill of the firearm user.

The skill of the firearm user can be improved through practice, instruction regarding technique and shooting fundamentals, as well as employment of various training scenarios and target presentations. Such training can include the use of static targets and moving targets, including various pop-up targets and targets moved on tracks or lines.

Presentation of different training scenarios and the use of live ammunition allow a firearm user to test their skill in realistic and competitive ways. For example, the firearm user can test their accuracy and consistency under a dynamic scenario during which one or more targets are presented that require one or more shots per target. This scenario may also require engagement of only certain targets, while further necessitating various manipulations of the firearm, such as deployment of the firearm (e.g., unholstering/holstering a sidearm), reloading or magazine changes, or switching between firearm types. Metrics can be collected during such training scenarios regarding shot placement and engagement time, for example, which allow the firearm user to be scored and evaluated, whether for competition or to demonstrate attainment of a desired proficiency.

There is a continuing need for a target shooting system that provides a more realistic training experience for law enforcement, military, and sport shooters. Desirably, the target shooting system allows the sequence of the targets, number of hits per target to provide an action, timing, and scoring to be controlled and reported through a remote or mobile device.

SUMMARY

In concordance with the instant disclosure, a target shooting system that provides a more realistic training experience for law enforcement, military, and sport shooters, and which allows the sequence of the targets, number of hits per target to provide an action, timing, and scoring to be controlled and reported through a remote or mobile device, is surprisingly discovered.

The present technology includes systems, processes, and articles of manufacture that relate to target shooting systems.

In one embodiment, a target shooting system includes one or more target units, each target unit having an actuator coupled to a target member and a base member. The actuator is configured to move the target member relative to the base member. Impact sensors are coupled to the target member. The impact sensors are configured to provide a signal when the target member receives an impact. A controller is in communication with the actuator and the impact sensor. The controller is configured to cause the actuator to move the target member relative to the base member and to receive the signal from the impact sensor. The controller may be a programmable logic controller (PLC), for example.

The controller may also be in communication with an electronic remote control via at least one of a wired connection (e.g., over the Internet) and a wireless connection (e.g., over a wireless network or by direct wireless communication). The electronic control permits a user to at least one of remotely set a sequence of the target to activate/fall; set a time duration of the target to be active; set a number of hits required on the target to make it fall; set time sequence; time the sequence from activating a start sound to last shot, record the number of hits from each sequence; and measure reaction times for each target.

In a particular embodiment, the impact sensor can be one of a plurality of impact sensors, where the plurality of impact sensors is arranged in a manner that permits the controller to identify a location of the impact on the target member. The signal from an impact sensor may include the location, or the controller can calculate the location from multiple signals received from multiple impact sensors.

The target shooting system can further include a remote device that is in communication with the controller. In this way, the controller can communicate receipt of the signal and the location to the remote device. The remote device can be in communication with controllers of multiple target units.

In exemplary embodiments, the portable target system utilizes mobile applications to control more realistic engagement scenarios to shooters, utilizing a variety of firearms and ammunition. The target system controls the movements of pop-up targets, shows the locations of hits on the target, measures reaction times, time sequences, and scores, and allows real time observations and data acquisition. The system activates with the push of a button on a mobile device or tablet. Targets are caused to move and react based on a sequence that may be established and set up on the smart device, then fall based on engagement criteria that is assigned via the smart device.

The controller of the target system can be easily programmed from the mobile device or a computer. The system executes the presentation of the targets in the order assigned, and fall based on the number of hits assigned to each target to make them fall. The user can also assign by the mobile device the maximum times that the target will be exposed. The mobile device controlled system calculates the time from the start tone until all targets are successfully engaged, or the time runs out, for the timed portion of scoring a run—as well as tracking target to target times. Scoring from the locations of the hits can automatically or manually be entered into the mobile device to derive a total score for the run. Hits on the target will also automatically be visible on the mobile device display and complete scoring will be automatic with "no hit" data automatically acquired-calculated by the system utilizing the sound of a shot and impact data.

Additionally, analytical and performance data can be instantly viewed on the mobile device controlling the sequence and any other mobile devices in an observation mode logged onto the sequence. Skills and performance can instantly be gauged and tracked via the mobile device in communication with the controller.

Further areas of applicability will become apparent from the detailed description provided herein. The detailed description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure. The above, as well as other advantages of the present disclosure, will become readily apparent to those skilled in the art from the following detailed description, particularly when considered in the light of the drawings described hereafter.

DETAILED DESCRIPTION

Figure 1:
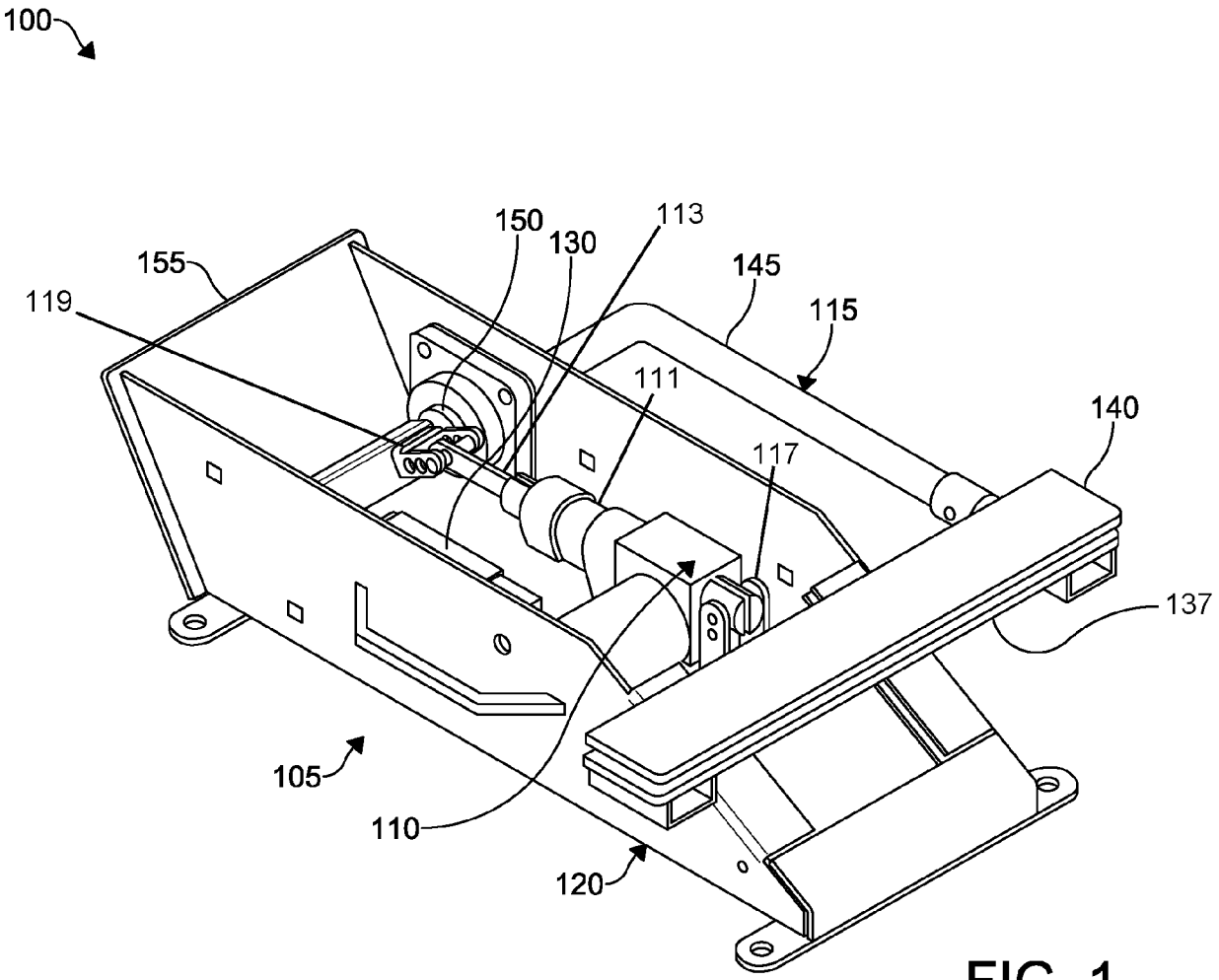
FIG. 1 is a perspective view of a target unit of a target shooting system, showing the target unit having a target member in a fallen position, where the target member is not fitted with a target portion.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. Except where otherwise expressly indicated, all numerical quantities in this description are to be understood as modified by the word "about" and all geometric and spatial descriptors are to be understood as modified by the word "substantially" in describing the broadest scope of the technology.

The present technology provides dynamic target shooting systems that can control presentation of one or more targets and report and score target impacts. The target shooting system can utilize an application on a remote or mobile device to control various realistic engagement scenarios for firearm users and is suitable for a variety of firearm types and ammunition types. The target shooting system can control the movements of targets, report and show the locations of impacts on the targets, measure reaction times, time sequences, score, and allow real time observations and data acquisition. The target shooting system can be activated with the push of a button on a remote device, such as a mobile device or tablet. Targets can move and react based on predetermined or programmable sequences that can be selected or created using the remote device. The targets can be presented and/or fall based on assigned engagement criteria.

The target shooting system, for example, can be programmed using a remote device, such as a smart phone, to execute a presentation of the targets in an assigned order and fall based on a number of assigned impacts, where target presentation timing and exposure duration can also be controlled. The remote device can calculate the time from a start tone until all targets are successfully engaged, or when a predetermined time runs out, for the timed portion of scoring a run, as well as tracking target-to-target times. Scoring from the locations of the hits can be automatically or manually entered into the remote device to derive a total score for the run. Impacts on the target can be automatically visible on the remote device display, and complete scoring can be automatic and include impact location data.

A firearm user's performance data can be instantly viewed on the remote device that is controlling the target shooting system and can also be viewed on additional remote devices communicating with the target shooting system in an observation mode, for example. Skill and performance can therefore be instantly gauged and tracked and can be compared with other shooters and/or historical data for a particular user.

The target shooting system can operate in the following ways:

1) Set sequence of targets to activate/fall using the remote device.

2) Set time duration of targets to be active using the remote device.

3) Set the number of impacts required on a target to make it fall using the remote device.

4) Automatically time the sequence; e.g., from activating a start sound to last shot.

5) Record the number of hits from each sequence.

6) Identify the location of each impact in real time.

7) Automatically score the round based on time and location of impacts.

The dynamic nature of the target shooting system allows a firearm user to train for realistic scenarios, in order to develop reaction times and mechanics. Live fire training situations and be rapidly set up, and can be changed or randomized to prevent users or observers from learning or memorizing a particular sequence. This can increase training value and gauge adaptability of a user. The system can also instantly evaluate activity and score individuals in relation to each other, view reaction times, or assess team skills utilizing key performance data, including specific impact locations on the target(s).

Figure 2:
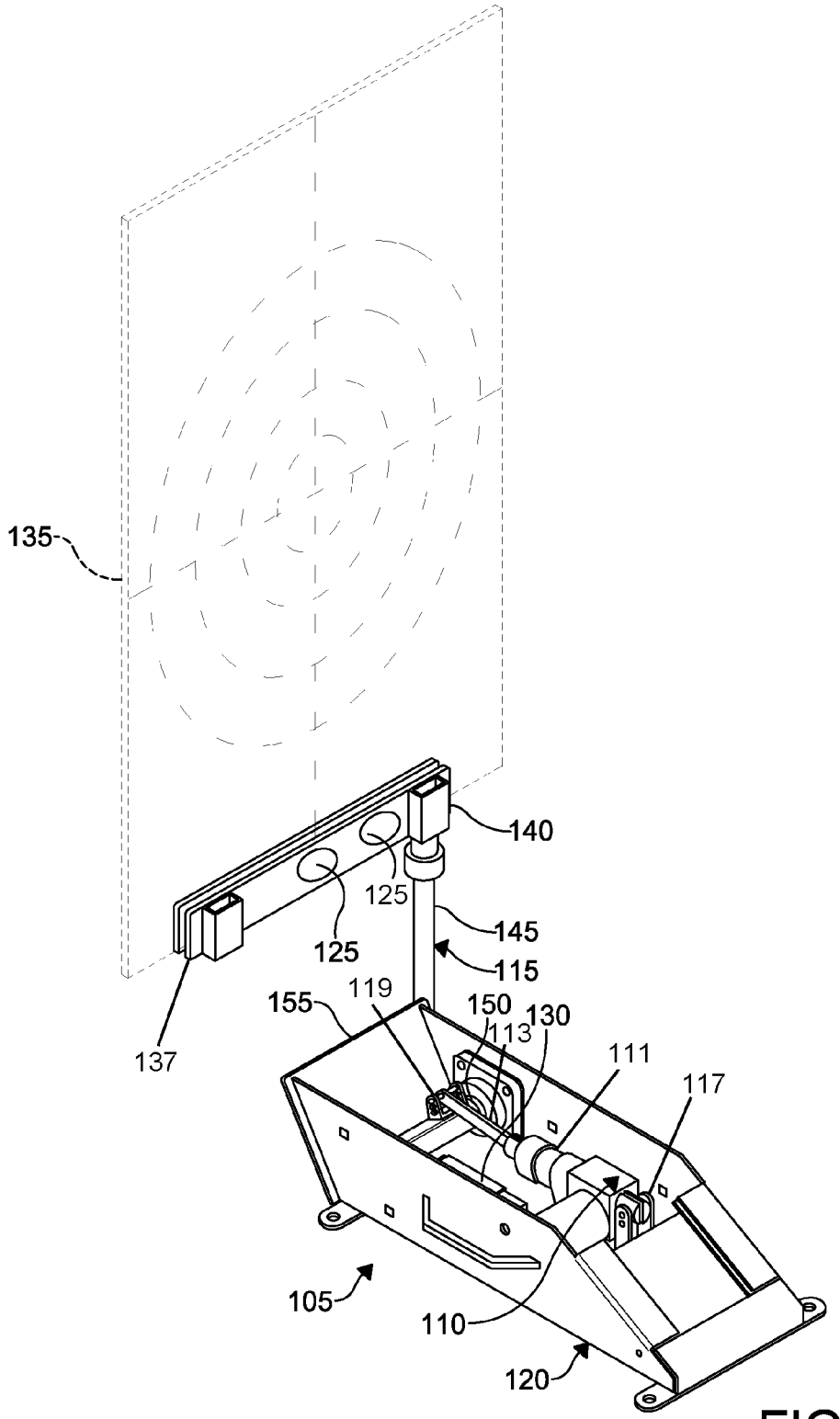
FIG. 2 is a perspective view of the target unit of the target shooting system illustrated in FIG. 1, showing the target unit having the target member in an upright position, where the target member is fitted with a target portion.

With reference now to FIGS. 1-5, various aspects and configurations of the target shooting system 100 are shown. The target shooting system 100 can include one or more target units 105. Each target unit 105 can include an actuator 110 coupled to a target member 115 and a base member 120. The actuator 110 can be configured to move the target member 115 relative to the base member 120. For example, the actuator 110 may be configured to rotate or pivot the target member 115 from an upright position to a fallen position during operation of the target unit 105. As shown in FIGS. 1 and 2, the actuator 110 includes a main body 111 and a selectively extendable arm 113. The main body 111 is pivotally coupled to the bottom wall of the base member 120 with a first bracket 117. The selectively extendable arm 113 is pivotally coupled to an end of an elongate member 145 with a second bracket 119. The selectively extendable arm 113 pivots upwardly and away from the bottom wall, as shown in FIG. 2, upon the extension of the selectively extendable arm 113.

An impact sensor 125 can be coupled to the target member 115 and can be configured to provide a signal when the target member 115 receives an impact from a projectile, for example. A controller 130 is in communication, for example, via a wired or a wireless connection, with the actuator 110 and the impact sensor 125. The controller 130 may be configured to receive the signal from the impact sensor 125 and to cause the actuator 110 to move the target member 115 relative to the base member 120.

The actuator 110 can include an electric motor, a hydraulic motor, or a pneumatic motor, as nonlimiting examples, to drive motion of the target member 115 relative to the base member 120. Where the actuator 110 is an electric motor, the actuator 110 may be powered by a power source such as a battery, for example, which facilitates the portability of the target shooting system 100. In certain embodiments, the target shooting system 100 may further have a solar panel (not shown) that permits a charging of the battery, and which likewise contributes to a portability of the system 100.

For example, the actuator 110 can move the target member 115 between a first position to a second position, such as the fallen position (shown in FIG. 1) and the upright position (shown in FIG. 2). The target member 115 can also be moved throughout a series of discrete positions intermediate the first position and the second position, or the target member 115 can be moved continuously throughout a range of motion relative to the base member 120, as desired.

In certain embodiments, the actuator 110 can rapidly move the target member 115 relative to the base member 120, causing the target member 115 to spring up to the upright position or immediately drop to the fallen position. As depicted in FIGS. 1-5, the actuator 110 is configured to pivot or rotate the target member 115 between the fallen position shown in FIG. 1 and the upright position shown in FIG. 2 relative to the base member 120. However, other types of motion are possible, where the actuator 110 can be configured to spin the target member 115, including turning the target member 115 by 90° to switch the presentation between a full profile and a side profile or turning the target member 115 by 180° to switch the presentation between a frontside and backside of the target member 115. Still other types of movement of the target member 115 relative to the base member 120 are contemplated and within the scope of the present disclosure. These include rocking the target member 115 side-to-side, linear or arcuate translation of the target member 115, and combinations of the various types of motion described.

As shown in FIGS. 2-5, the target member 115 includes a target portion 135 held by a frame 137 that is coupled to one end 140 of the elongate member 145, and where the actuator 110 is coupled to another end 150 of the elongate member 145. The target portion 135 can include one or more various types of targets, such as a bullseye, silhouette, or a target standard established by the International Olympic Committee, International Shooting Sport Federation, National Rifle Association, International Defensive Pistol Association, or the International Practical Shooting Confederation, for example. The target portion 135 may have any shape, as desired, and as a nonlimiting example may include a full size IDPA, or IPSC, target. An entirety of the target member 115 or a portion of the target member 115 (e.g., the target portion 135) can be made of various materials configured to withstand impact of various firearm projectiles, including various types of steel, e.g., AR500 steel.

The target shooting system 100 can also include a deflection plate 155 that is resistant to firearm projectiles, in order to protect at least a portion of the target shooting system 100. For example, as shown in FIGS. 1-4, a portion of the base member 120 can include the deflection plate 155 to protect the actuator 110 and controller 130 from projectiles coming from a specific direction. Certain embodiments of the base member 120 can include one or more deflection plates 155, where the deflection plates 155 are coupled to portions of the base member 120, or where the deflection plates 155 serve as portions of the base member 120. In some embodiments, the entire base member 120 can be formed of the same material as the deflection plate 155.

The impact sensor 125 can include one or more, and various types of, sensors capable of detecting when the target member 115 receives an impact. For example, the target portion 135 of the target member 115 can include one or more vibration sensors and/or pressure sensors. Where a plurality of impact sensors 125 is present, the plurality of impact sensors 125 can be configured to identify a location of the impact on the target member 115 and the signal(s) provided by the impact sensor(s) 125 can include the location.

In certain embodiments, the plurality of impact sensors 125 can be configured to identify the location of the impact on the target member 115 by triangulation. For example, the controller 130 can receive the signals from the impact sensors 125 and determine the location of the impact based on which impact sensors 125 provided signals and/or based a strength of the signals provided by the impact sensors 125.

Figure 3:
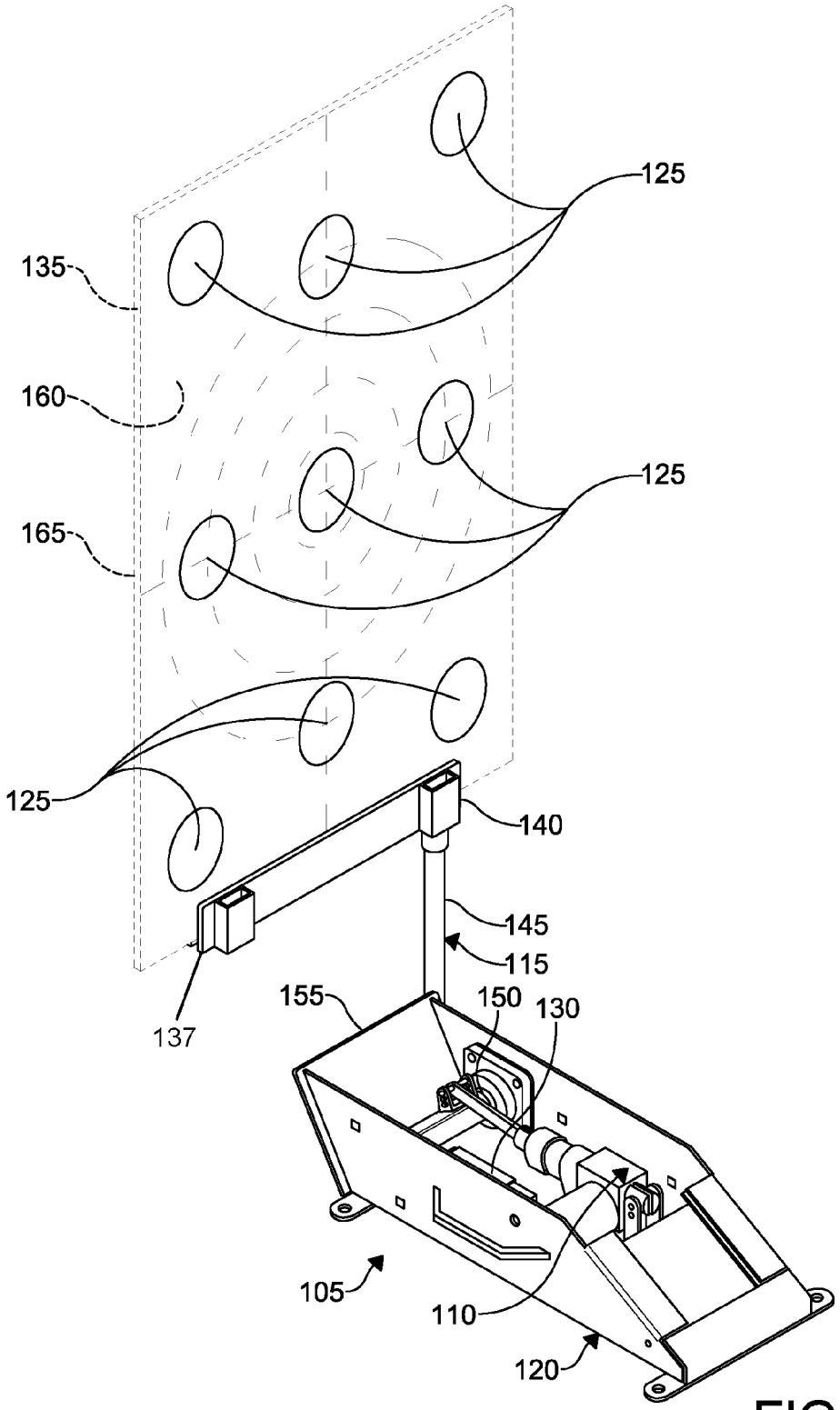
FIG. 3 is a perspective view of the target unit of the target shooting system illustrated in FIGS. 1 and 2, showing the target unit having the target member in the upright position, where the target member is fitted with a target portion having a plurality of vibration sensors configured to identify a location of an impact on the target member.
Figure 4:
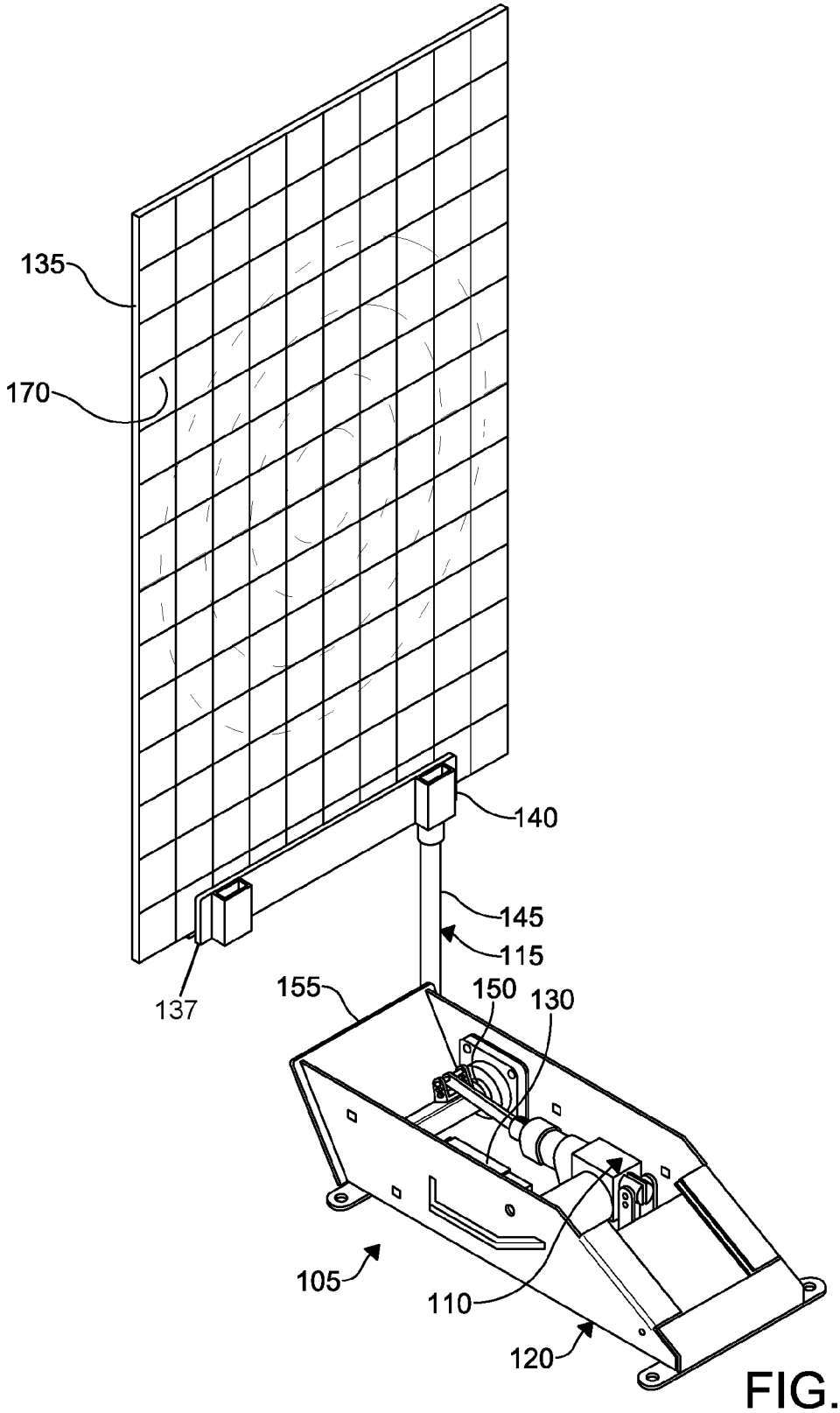
FIG. 4 is a perspective view of a target unit of the target shooting system illustrated in FIGS. 1 and 2, showing the target unit having the target member in the upright position, where the target member is fitted with a target portion having a plurality of pressure sensors configured to identify a location of an impact on the target member.

As shown in FIG. 3, an array of impact sensors 125 comprising vibration sensors can be placed on a backside 160 of the target portion 135 to detect a location of an impact on the frontside 165 of the target portion 135. As shown in FIG. 4, the target portion 135 can include a grid 170 of impact sensors 125 configured as pressure sensors, where impact of a pressure sensor identifies the impact location. Other suitable locations and arrangements for the impact sensors 125 may also be employed by a skilled artisan, as desired.

In some embodiments, the controller 130 can be configured to cause the actuator 110 to move the target member 115 relative to the base member 120 upon receipt of the signal(s). For example, impact on the target portion 135 of the target member 115 can cause the actuator 110 to move the target member 115 relative to the base member 120, e.g., from the upright position as shown in FIG. 2 to the fallen position as shown in FIG. 1. The controller 130 can also be configured to cause the actuator 110 to move the target member 115 relative to the base member 120 upon receipt of the signal when the signal identifies a particular detected or calculated location. In this way, the target member 115 may only move from the upright position to the fallen position when an impact having a desired accuracy is achieved, such as an impact at a bullseye or other particular location on the target portion 135 of the target member 115.

Figure 5:
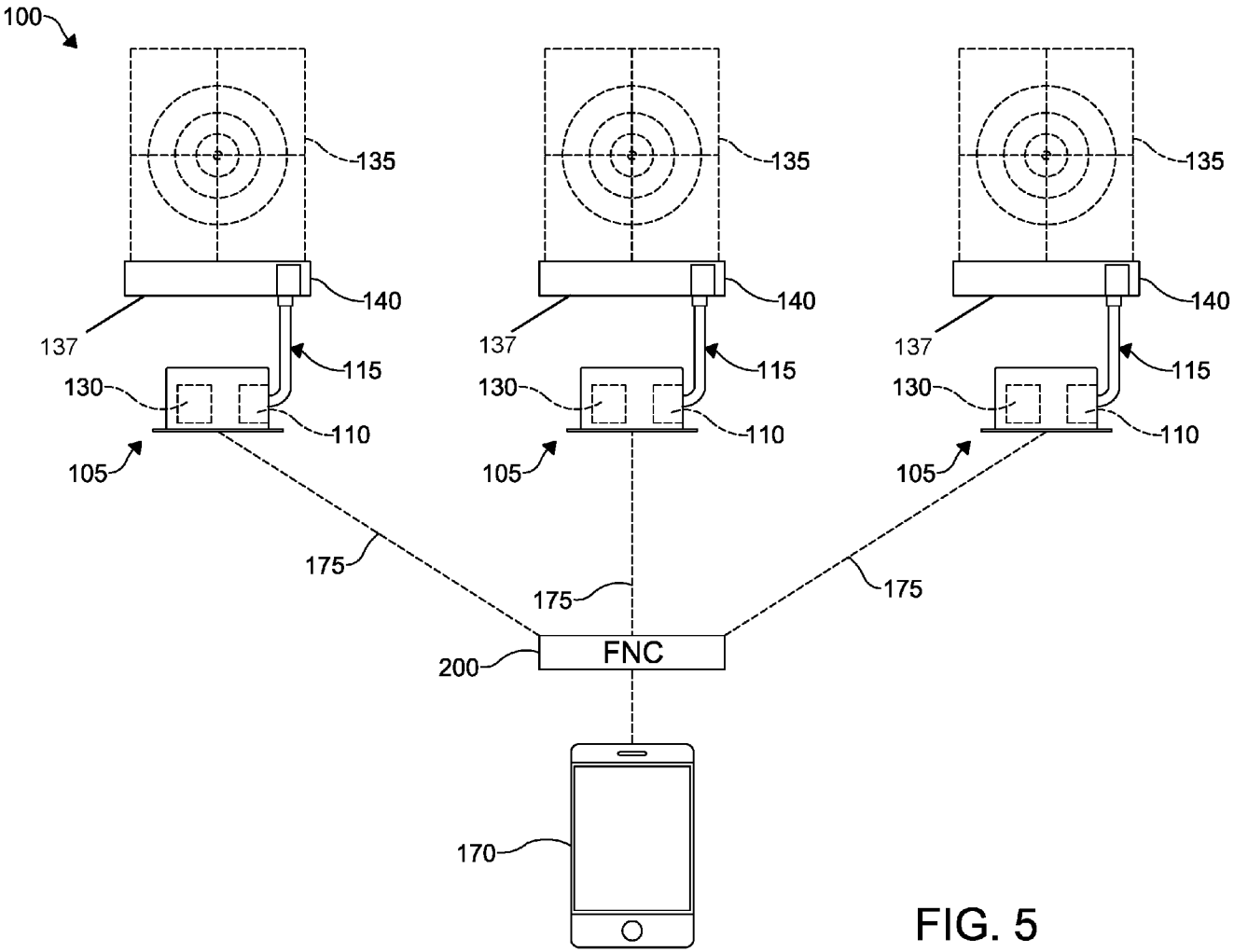
FIG. 5 is a schematic of a target shooting system including a plurality of target units in communication with a remote device.

The target shooting system 100 can include a remote device 170 in communication with the controller 130. As shown in FIG. 5, for example, the remote device 170 can be a mobile device, such as a smart phone, that can have installed thereon a software application that permits the smart phone to communicate wirelessly 175 with the controllers 130 of multiple target units 105.

As illustrated in FIG. 5, the remote device 170 may communicate with the controllers 130 via a field network controller or FNC 200. The FNC 200 is configured to send and receive signals from multiple controllers 130 to the remote device 170, and vice-versa. The FNC 200 may be a computer suitably protected against the elements, for example, with an impact- and/or water-resistant casing, and having a processor, memory with non-transitory processor-executable instructions tangibly embodied thereon, and radio transmitter and receiver components. Desirably, the FNC 200 allows the single remote device 170 to communicate efficiently with more than one of the controllers 130, thereby facilitating a more realistic training experience for the user.

Communication between one or more controllers 130 and the remote device 170 allows the target shooting system 100 to be configured and operated in several different ways. Where a plurality of impact sensors 125 is used, the plurality of impact sensors 125 can be configured to identify a location of the impact on the target member 115. Thus, the signal(s) from the impact sensors 125 to the controller 130 can either include the location of the impact on the target member 115, or can permit the controller 130 to calculate (e.g., via triangulation) the location of the impact on the target member 115. The controller 130 can communicate receipt of the signal(s) and the location to the remote device 170.

Additional aspects of communication between the remote device 170 and the controller 130 can include: the controller 130 communicating receipt of the signal to the remote device 170; the remote device 170 communicating an instruction to the controller 130 to cause the actuator 110 to move the target member 115 relative to the base member 120, the remote device 170 communicating an instruction to the controller 130 to cause the actuator 110 to move the target member 115 relative to the base member 120 for a given time; the remote device 170 communicating an instruction to the controller 130 to cause the actuator 110 to move the target member 115 relative to the base member 120 at a given time; the remote device 170 communicating an instruction to the controller 130 to cause the actuator 110 to move the target member 115 relative to the base member 120 when the target member 115 receives a given number of impacts; and combinations thereof.

The remote device 170, the controller 130, or the remote device 170 and the controller 130 can include a processor and a memory. The processor can be configured to execute computer-readable instructions and the memory can include a tangible non-transitory computer-readable medium having the computer-readable instructions embodied thereon. The computer-readable instructions when executed by the processor permit the remote device 170 and/or the controller 130 to cause the target system 100 to operate in accordance with the methods and steps disclosed herein.

Communication between the remote device 170 and the controller 130 can result in the actuator 110 moving the target member 115 relative to the base member 120 by the processor executing the computer-readable instructions. The remote device 170 can include a set of instructions to communicate to the controller 130 to operate one or more target units 105 and/or the remote device 170 can instruct the controller to carry out a predetermined set of instructions stored in the controller 130. Communication between the remote device 170 and the controller 130 can therefore control one or more target units 105 by: setting a sequence for the actuator 110 to move the target member 115; setting a time duration of the target member 115 to be in a certain position (e.g., upright position or fallen position); setting a number of impacts required on the target member 115 to make it move (e.g., from an upright position to a fallen position); setting time sequence for target units 105; timing the sequence from activating a start sound to a last shot; and recording the number of impacts from each sequence.

In certain embodiments, and as shown in FIG. 5, the target shooting system 100 includes more than one target unit 105, where each target unit 105 has an actuator 110, an impact sensor 125, and a controller 130. Each actuator 110 couples a target member 115 to a base member 120, the actuator 110 configured to move the target member 115 relative to the base member 120. The impact sensor 125 is coupled to the target member 115 and is configured to provide a signal when the target member 115 receives an impact. The controller 130 is in communication with the actuator 110 and the impact sensor 125, where the controller 130 is configured to cause the actuator 110 to move the target member 115 relative to the base member 120 and to receive the signal from the impact sensor 125. The target shooting system 100 also includes a remote device 170 in communication with the controller 130 of each target unit 105. The impact sensor 125 of at least one target unit can be one of a plurality of impact sensors 125, where the plurality of impact sensors 125 are configured to identify a location of the impact on the target member 115, and the signal from the impact sensor 125 to the controller 130 can include the impact location. The controller 130 can communicate receipt of the signal and the location to the remote device 170 for the respective target unit 105.

The remote device 170 can therefore communicate with the controllers 130 of multiple target units 105 in various ways, including communicating the same or different instructions to multiple target units 105. Communication between the remote device 170 and the various controllers 130 can include one or more of the following: the controller 130 communicating receipt of the signal to the remote device 170; the remote device 170 communicating an instruction to the controller 130 to cause the actuator 110 to move the target member 115 relative to the base member 120; the remote device 170 communicating an instruction to the controller 130 to cause the actuator 110 to move the target member 115 relative to the base member 120 for a given time; the remote device 170 communicating an instruction to the controller 130 to cause the actuator 110 to move the target member 115 relative to the base member 120 at a given time; and the remote device 170 communicating an instruction to the controller 130 to cause the actuator 110 to move the target member 115 relative to the base member 120 when the target member 115 receives a given number of impacts.

Advantageously, the target shooting system 100 of the present disclosure allows a user to: set a sequence of targets to activate fall in the mobile device 170 utilizing a field network control module; set time duration of targets to be active in a mobile device; set the number of hits required on a target to make it fall in the mobile device 170; automatically time the sequence (from activating a start sound to last shot; record the number of hits from each sequence in the mobile device 170; identify the location of each impact in real time; and automatically score the round based on time and location of hits.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A target shooting system, comprising:

a base member including a housing with an angled deflection plate, a bottom wall, and a pair of sidewalls, the sidewalls spaced apart from one another and connected by the bottom wall, the sidewalls also attached to the angled deflection plate, and one of the sidewalls having a handle disposed on an outer surface thereof;

a frame for holding a target, the target configured to be impacted by a firearm projectile;

a substantially L-shaped elongate member rotatably disposed through one of the sidewalls at a location that is adjacent to the angled deflection plate, one end of the elongate member attached to the frame, and an other end of the elongate member disposed between the sidewalls of the base member inside of the housing;

an actuator disposed between the sidewalls of the base member and coupled to the other end of the elongate member and the bottom wall of the base member, wherein the actuator includes a main body and a selectively extendable arm, the main body pivotally coupled to the bottom wall of the base member with a first bracket, and the selectively extendable arm pivotally coupled to the other end of the L-shaped elongate member with a second bracket, the actuator configured to move the target relative to the base member by rotating the other end of the L-shaped elongate member upon an extension of the selectively extendable arm from the main body of the actuator, and wherein the selectively extendable arm pivots upwardly and away from the bottom wall upon the extension of the selectively extendable arm;

a plurality of impact sensors directly coupled to the frame and not directly coupled to the target, each of the plurality of impact sensors configured to provide a signal when the target receives an impact from the firearm projectile;

a target controller disposed inside of the base member and in communication with the actuator and the impact sensors, the controller configured to selectively cause the actuator to move the target relative to the base member and to receive the signals from the impact sensors, wherein the target controller is further configured to calculate a location of the impact by the signals received from the impact sensors;

a remote device configured to receive communications from the target controller, and configured to send communications to the target controller, and a field network controller disposed remote from and in communication with both the target controller and the remote device, wherein the communications from the target controller to the remote device are relayed through the field network controller, and the communications to the target controller from the remote device are relayed through the field network controller.

2. The target shooting system of claim 1, wherein the actuator includes one of an electric motor, a hydraulic motor, and a pneumatic motor.

3. The target shooting system of claim 1, wherein each of the impact sensors comprises a vibration sensor or a pressure sensor.

4. The target shooting system of claim 1, wherein the target controller is configured to identify the location of the impact by triangulation.

5. The target shooting system of claim 1, wherein the target controller is configured to cause the actuator to move the target relative to the base member upon a calculation of a particular location by the target controller.

6. The target shooting system of claim 1, wherein the communication between the remote device and the target controller includes one of:

(a) the target controller communicating receipt of the signal to the remote device;

(b) the remote device communicating an instruction to the target controller to cause the actuator to move the target relative to the base member;

(c) the remote device communicating an instruction to the target controller to cause the actuator to move the target relative to the base member for a given time;

(d) the remote device communicating an instruction to the target controller to cause the actuator to move the target relative to the base member at a given time; and (e) the remote device communicating an instruction to the target controller to cause the actuator to move the target relative to the base member when the target receives a given number of impacts.

7. The target shooting system of claim 6, wherein the communication between the remote device and the target controller includes at least two of (a), (b), (c), (d), and (e).

8. The target shooting system of claim 1, wherein one of the remote device and the target controller includes a processor and a memory, the processor configured to execute computer-readable instructions, the memory including a tangible non-transitory computer-readable medium having the computer-readable instructions embodied thereon, the communication between the remote device and the target controller resulting in the actuator moving the target relative to the base member by the processor executing the computer-readable instructions.

9. A target shooting system, comprising:

a plurality of target units, each target unit including:

a base member including a housing with an angled deflection plate, a bottom wall, and a pair of sidewalls, the sidewalls spaced apart from one another and connected by the bottom wall, the sidewalls also attached to the angled deflection plate, and one of the sidewalls having a handle disposed on an outer surface thereof;

a frame for holding a target, the target configured to be impacted by a firearm projectile;

a substantially L-shaped elongate member rotatably disposed through one of the sidewalls at a location that is adjacent to the angled deflection plate, one end of the elongate member attached to the frame, and an other end of the elongate member disposed between the sidewalls of the base member inside of the housing;

an actuator disposed between the sidewalls of the base member and coupled to the other end of the elongate member and the bottom wall of the base member, wherein the actuator includes a main body and a selectively extendable arm, the main body pivotally coupled to the bottom wall of the base member with a first bracket, and the selectively extendable arm pivotally coupled to the other end of the L-shaped elongate member with a second bracket, the actuator configured to move the target relative to the base member by rotating the other end of the L-shaped elongate member upon an extension of the selectively extendable arm from the main body of the actuator, and wherein the selectively extendable arm pivots upwardly and away from the bottom wall upon the extension of the selectively extendable arm;

a plurality of impact sensors directly coupled to the frame and not directly coupled to the target, each of the plurality of impact sensors configured to provide a signal when the target receives an impact from the firearm projectile;

a target controller disposed inside of the base member and in communication with the actuator and the impact sensors, the controller configured to selectively cause the actuator to move the target relative to the base member and to receive the signals from the impact sensors, wherein the target controller is further configured to calculate a location of the impact by the signals received from the impact sensors; and a remote device in communication with the target controller of each target unit, the remote device configured to receive communications from the target controllers, and configured to send communications to the target controllers, wherein the remote device is configured to both program the target controllers to execute a presentation of the targets, and to display performance data of a user based on the signals from the impact sensors after an execution of the presentation of the targets; and a field network controller disposed remote from and in communication with both the target controllers and the remote device, wherein the communications from the target controllers to the remote device are relayed through the field network controller, and the communications to the target controllers from the remote device are relayed through the field network controller.

10. The target shooting system of claim 9, wherein the communication between the remote device and the target controller of one target unit includes one of:

(a) the target controller communicating receipt of the signal to the remote device;

(b) the remote device communicating an instruction to the target controller to cause the actuator to move the target relative to the base member;

(c) the remote device communicating an instruction to the target controller to cause the actuator to move the target relative to the base member for a given time;

(d) the remote device communicating an instruction to the target controller to cause the actuator to move the target relative to the base member at a given time; and (e) the remote device communicating an instruction to the target controller to cause the actuator to move the target relative to the base member when the target receives a given number of impacts; and the communication between the remote device and the target controller of another target unit includes one of:

(f) the target controller communicating receipt of the signal to the remote device;

(g) the remote device communicating an instruction to the target controller to cause the actuator to move the target relative to the base member;

(h) the remote device communicating an instruction to the target controller to cause the actuator to move the target relative to the base member for a given time;

(i) the remote device communicating an instruction to the target controller to cause the actuator to move the target relative to the base member at a given time; and (j) the remote device communicating an instruction to the target controller to cause the actuator to move the target relative to the base member when the target receives a given number of impacts.

11. The target shooting system of claim 10, wherein the communication between the remote device and the target controller of the one target unit includes at least two of (a), (b), (c), (d), and (e) and the communication between the remote device and the target controller of the another target unit includes at least two of (f), (g), (h), (i), and (j).

* * * * *